US005303805A

United States Patent [19]

Hauser

[11] Patent Number: 5,303,805

[45] Date of Patent: Apr. 19, 1994

[54] LUGGAGE BAG WITH COLLAPSIBLE INNER FRAME AND WHEELS

[76] Inventor: Stephen G. Hauser, 4133 Aleman Dr., Tarzana, Calif. 91356

[21] Appl. No.: 891,188

[22] Filed: Jun. 1, 1992

[51] Int. Cl.[5] ..... A45C 5/14; A45C 7/00; A45C 13/04

[52] U.S. Cl. ..... 190/18 A; 190/107; 190/122; 206/287.1

[58] Field of Search ..... 190/1, 18 R, 12 A, 127, 190/122, 107; 206/287.1

[56] References Cited

U.S. PATENT DOCUMENTS

| | | | |
|---|---|---|---|
| 518,270 | 4/1899 | Orth | 190/103 |
| 905,759 | 12/1908 | Strauss | 190/18 A X |
| 1,273,875 | 7/1918 | Kosta | 190/127 |
| 1,859,052 | 5/1932 | Ritter, Jr. . | |
| 1,895,677 | 1/1933 | Pinheiro | 190/18 A |
| 2,016,520 | 10/1935 | Short | 190/107 X |
| 2,710,084 | 6/1955 | Braverman | 190/107 |
| 2,754,945 | 7/1956 | Kish, Jr. | 190/127 |
| 3,221,848 | 12/1965 | O'Neil . | |
| 3,881,579 | 5/1975 | Keerdoja | 190/103 |
| 4,062,429 | 12/1977 | Tabor et al. | 190/18 A |
| 4,176,734 | 12/1979 | Wang | 190/127 X |
| 4,210,230 | 7/1980 | Weiner | 190/107 |
| 4,588,056 | 5/1986 | Bernbaum | 190/107 |
| 4,629,040 | 12/1986 | Jones | 190/102 |
| 4,630,717 | 12/1986 | Tong | 190/107 X |
| 4,979,598 | 12/1990 | Verheij et al. | 190/18 A |
| 4,984,662 | 1/1991 | Jacober | 190/107 |

FOREIGN PATENT DOCUMENTS

| | | | |
|---|---|---|---|
| 237691 | 9/1987 | European Pat. Off. | 190/127 |
| 216814 | 12/1909 | Fed. Rep. of Germany | 190/103 |
| 856929 | 8/1940 | France | 190/107 |
| 520473 | 4/1940 | United Kingdom | 190/107 |
| 580515 | 9/1946 | United Kingdom | 190/103 |
| 2245250 | 1/1992 | United Kingdom | 190/103 |

*Primary Examiner*—Sue A. Weaver
*Attorney, Agent, or Firm*—Kelly Bauersfeld & Lowry

[57] ABSTRACT

An improved luggage bag includes an internal rigidifying frame which can be actuated quickly and easily to shift the luggage bag between relatively rigid and relative flexible states. The internal frame comprises tension cables threaded through an interlocking succession of lock segments or links, in combination with an externally mounted actuator handle movable to apply tension to the cable and thereby draw the lock segments into an interlocking, relatively rigid configuration. Alternately, the actuator handle is movable to relax the cable tension and thereby permit the lock segments to assume a loose or flexible configuration.

21 Claims, 4 Drawing Sheets

FIG. 10
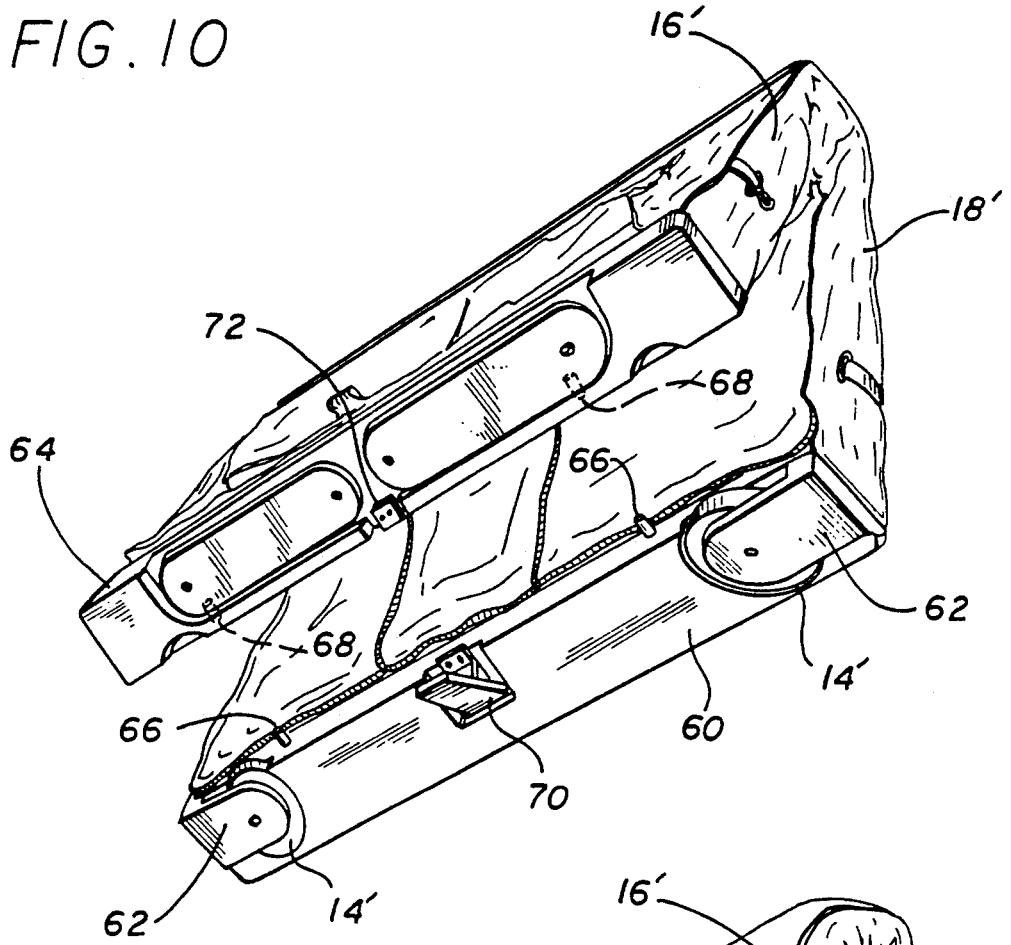
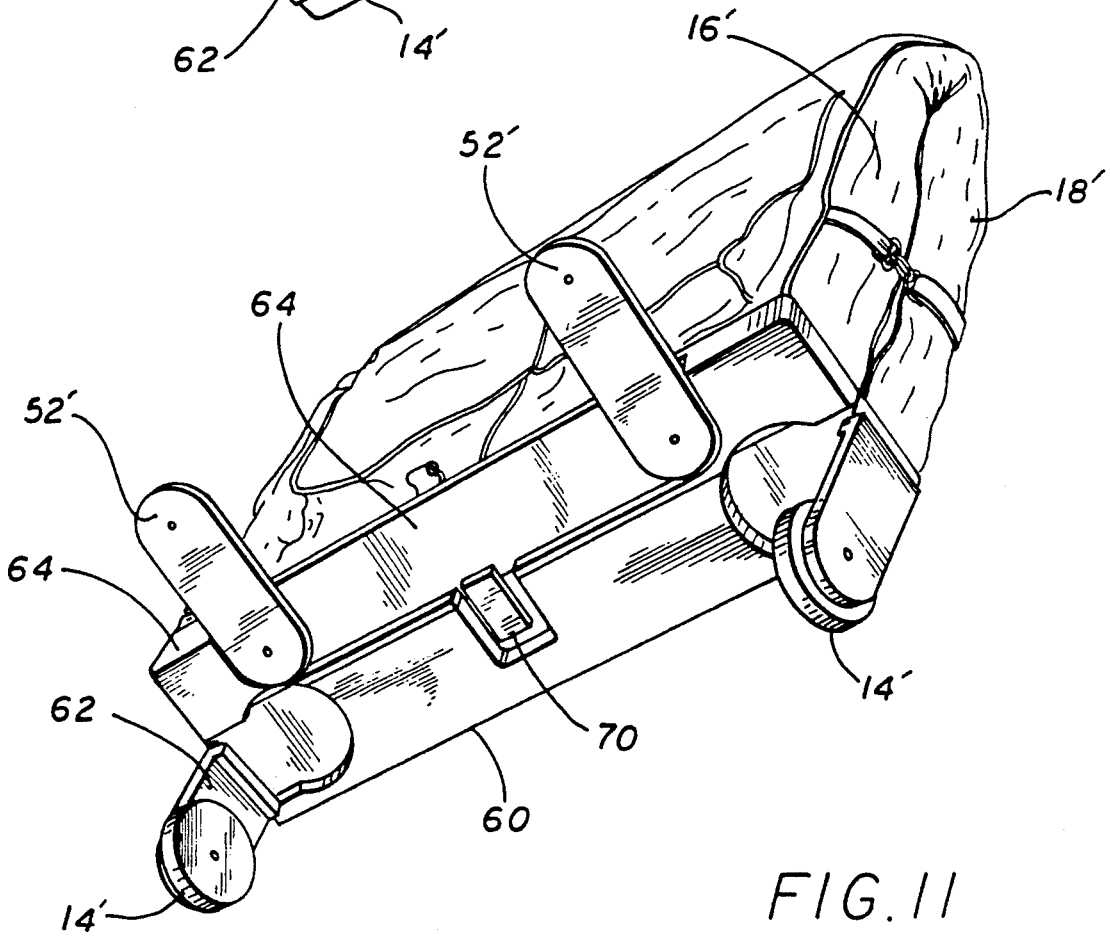
FIG. 11

LUGGAGE BAG WITH COLLAPSIBLE INNER FRAME AND WHEELS

BACKGROUND OF THE INVENTION

This invention relates generally to luggage items such as suitcases and garment bags and the like used by travelers to transport clothing and other personal items. More particularly, this invention relates to an improved luggage bag adapted to shift quickly and easily between a substantially rigid configuration, and a relatively soft and flexible configuration.

Luggage products such as suitcases and garment bags and the like are well-known for use by travelers to carry and store clothing and other personal items. Such luggage products are available in a wide variety of different sizes and shapes. In general terms, prior art luggage products have been constructed with a relatively rigid configuration having a hard outer shell or casing designed to protect items contained therein, or with a soft and flexible configuration designed to facilitate storage of the luggage product into a relatively small, tight-fitting space. In this regard, soft and flexible luggage products have achieved significant popularity in recent years as a result of their ability to deform for temporary placement into an overhead storage compartment on a passenger aircraft, or beneath an aircraft passenger seat, etc.

Although soft and flexible luggage bags are extremely popular among persons who travel frequently, the soft and flexible nature of the luggage product can be inconvenient and/or undesirable in certain situations. For example, the flexible, floppy nature of the soft luggage bag can make the luggage product difficult to maneuver and carry, especially when the luggage product is relatively heavy as a result of items packed therein. Moreover, soft luggage bags have not been adapted for use with integrated caster wheels to permit the luggage bag to be pulled with a rolling movement rather than carried; instead, a separate wheeled cart which must be carried and manipulated as a separate luggage item has been required. Still further, when the soft luggage bag is placed upon a floor or other support surface, the bag tends to assume a crumpled or disheveled configuration resulting in potential wrinkling of clothing and/or possible damage to other items contained therein.

There exists, therefore, a significant need for further improvements in luggage products, particularly with respect to providing a soft and flexible luggage bag for fitting compactly into tight-fitting storage spaces, but which otherwise provides the conveniences and advantages of a rigid luggage product for ease of handling and protection of clothing items contained therein. The present invention fulfill these needs and provides further related advantages.

SUMMARY OF THE INVENTION

In accordance with the invention, an improved luggage bag is provided with a relatively soft and flexible external construction, in combination with an internal rigidifying frame adapted to shift quickly and easily between relatively rigid and relatively flexible states. Accordingly, the internal frame can be rigidified to place the luggage bag in a rigid state for ease of carrying and handling. Alternately, the internal frame can be set in the relatively flexible state to accommodate luggage bag deformation for purposes of fitting the luggage bag into small or tight storage spaces.

In the preferred form of the invention, the luggage bag has a generally rectangular profile, as is typical for soft or rigid luggage products, folded-over garment bags, and the like. The rigidifying frame includes upper and lower, generally horizontally extending frame rails. These frame rails are interconnected generally at opposite ends by a tension cable threaded through an interlocking succession of tubular lock segments or links adapted to assume, when interlocked, a relatively stiff or rigid configuration. The tension cable and the associated lock segments may be concealed within elongated pockets formed within the luggage bag.

An actuator handle is mounted on the luggage bag, preferably on the upper rail in an accessible position on the exterior of the luggage bag. The actuator handle carries a cam wheel having the tension cables connected thereto. The actuator handle is rotatable between a first position in which the cable tension is relaxed to permit relatively loose and flexible movement of the lock segments, thereby placing the luggage bag in a soft and flexible state, to a second position applying substantial tension to the cables for purposes of drawing the lock segments into rigid interlocked relation.

In accordance with further aspects of the invention, the lower rail on the luggage bag conveniently supports one or more caster wheels for use in rolling support of the luggage bag. The actuator handle is designed to project upwardly and outwardly from the luggage bag in the rigid state to provide a convenient handle for manual trailering of the luggage bag.

Other features and advantages of the present invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 10 is a bottom side perspective view illustrating an alternative preferred form of the invention, with the luggage bag in a partially unfolded configuration; and FIG. 11 is a bottom side perspective view similar to FIG. 10, but showing the alternative embodiment in a folded and locked condition.

DETAILED DESCRIPTION OF THE PREFERRED EMBODIMENTS

Figure 1:
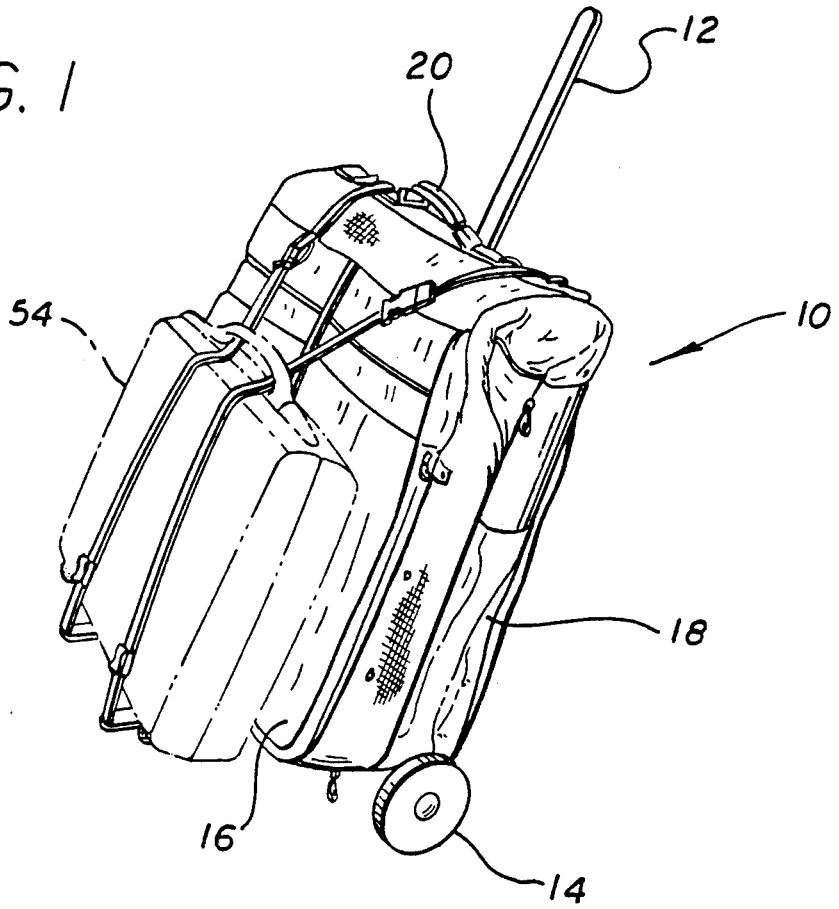
FIG. 1 is a front perspective view illustrating the luggage bag embodying the novel features of the invention, and depicted in a rigid state.
Figure 2:
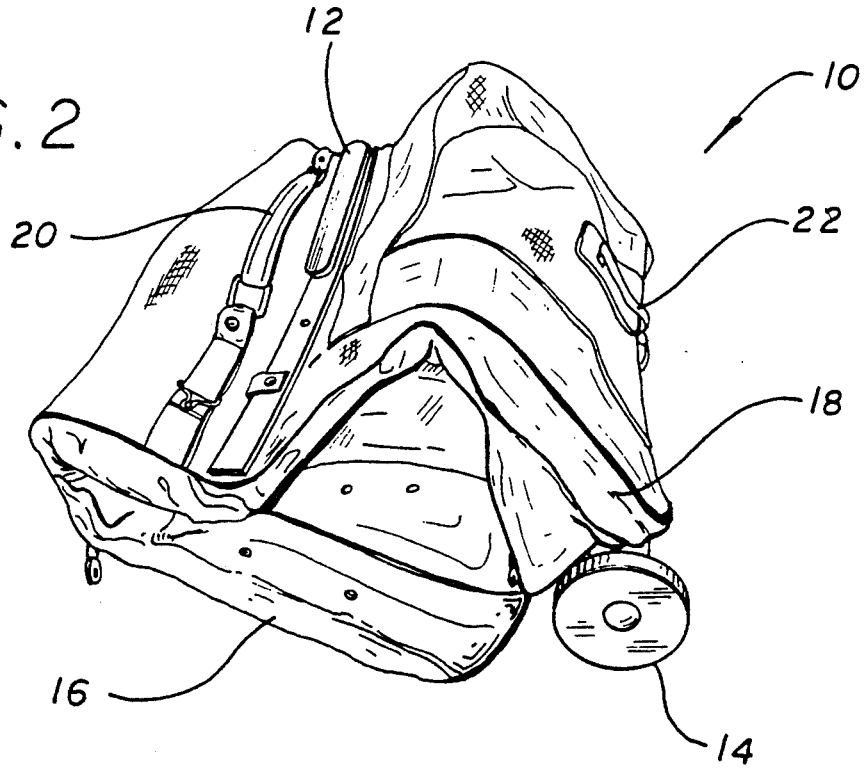
FIG. 2 is a perspective view of the luggage bag of FIG. 1, illustrating the luggage bag in a soft and flexible state.
Figure 3:
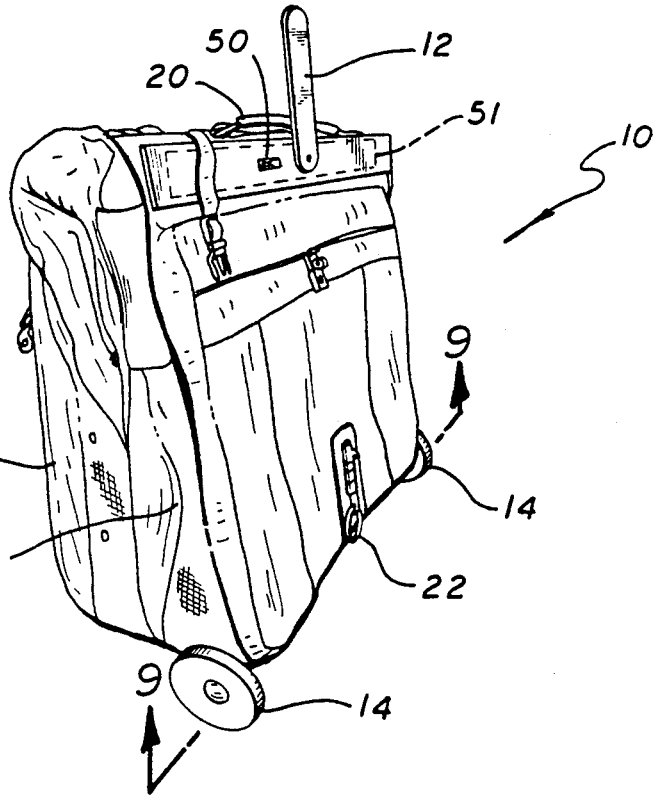
FIG. 3 is a rear perspective view of the luggage bag in the substantially rigid state.

As shown in the exemplary drawings, an improved luggage bag referred to generally in FIG. 1 by the reference numeral 10 is adapted for rapid conversion between a relatively rigid state (FIGS. 1 and 3) and a soft and flexible state (FIG. 2). The luggage bag 10 includes an externally mounted actuator handle 12 for operating an internal rigidifying frame (not shown in FIGS. 1-3) to select the desired rigid or flexible state.

The improved luggage bag 10 of the present invention has a soft and flexible outer construction which can be deformed to fit with relative ease into a snug or tight-fitting storage space, particularly such as an overhead or under-seat storage space on a commercial aircraft. However, the luggage bag 10 is also adapted to assume a rigidified, substantially rectangular configuration for facilitated handling and transport by normal carrying, or by trailered rolling on caster wheels 14. In either configuration, the luggage bag has a soft and flexible exterior defining the appropriate side and end walls to encase and protect clothing and other personal items, wherein some or all of the exterior side and end walls are formed from a flexible material such as a suitable lightweight fabric, vinyl or the like.

The illustrative drawings show the luggage bag 10 in the form of a folding garment bag having an upper portion 16 which overlies a lower or base portion 18. A conventional carrying handle 20 is provided generally at the fold juncture between the upper and lower portions 16 and 18 to permit normal handling and carrying of the luggage bag. A belt or strap 22 is provided to releasibly interconnect the free ends of the upper and lower portions 16, 18, thereby placing and retaining the garment bag in a folded, generally rectangular configuration. As is known in the art, the retainer belt 22 can be released to permit unfolding of the garment bag and corresponding access to clothing and other personal items packed therein. It will be understood, however, that the present invention is not confined to folding garment bags, but is instead applicable to flexible soft luggage products in general.

Figure 4:
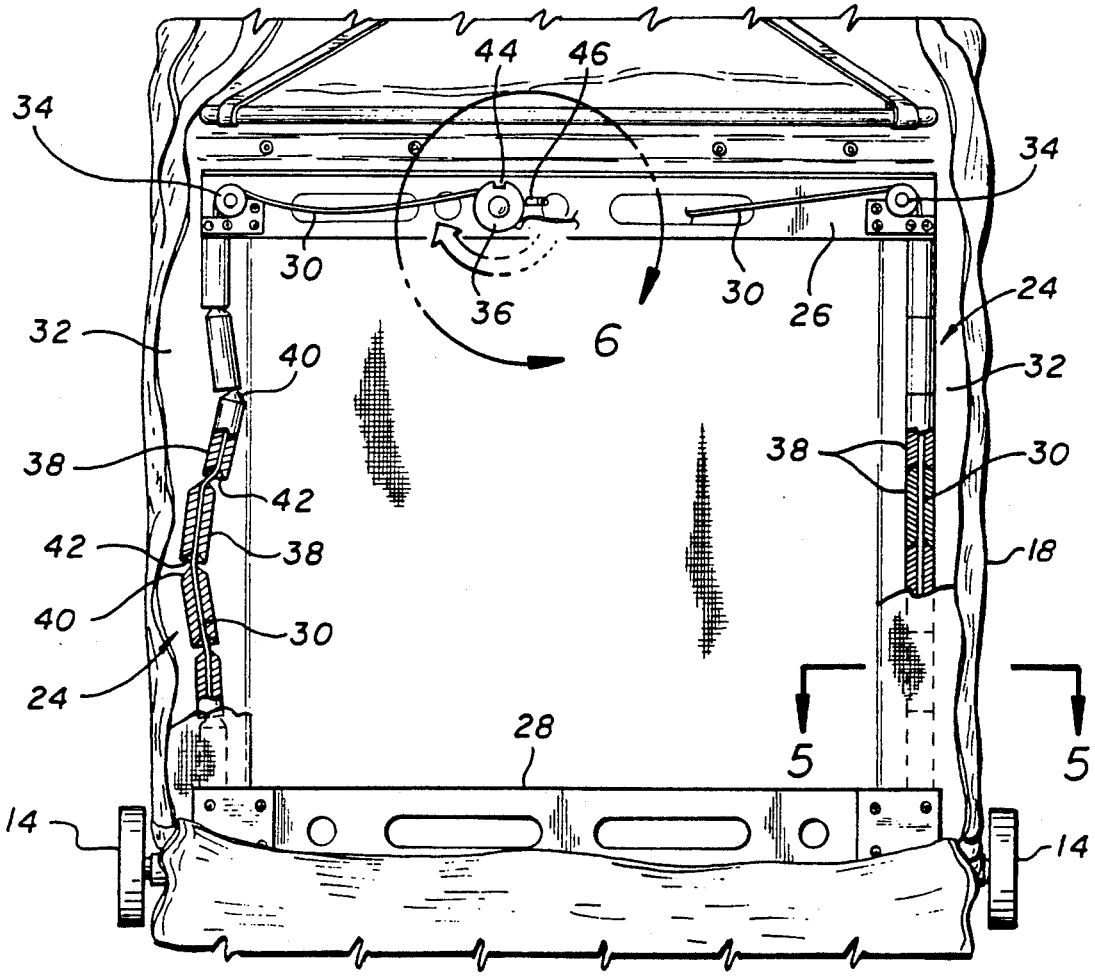
FIG. 4 is a fragmented plan view illustrating a collapsible inner frame within the luggage bag.

As shown best in FIG. 4, the improved luggage bag 10 includes the internal rigidifying frame 24 shown mounted within the lower or base portion 18 of the garment bag. The rigidifying frame 24 comprises upper and lower, relatively rigid rails 26 and 28 mounted within the bag generally at the upper and lower ends of the base portion 18, to extend horizontally or transversely across the bag width. These rails 26 and 28 prevent substantial deformation or flexing of the garment bag along the rail lengths, but otherwise permit substantial bag deformation in other directions.

The rigid rails 26 and 28 cooperate with releasible lock means for converting the bag 10 between the relatively rigid and relatively flexible states. As shown in FIG. 4, the lock means comprises a pair of tension cables 30 having lower ends connected to the lower rail 28 at the laterally opposite ends thereof. The tension cables 30 extend from the lower rail 28 through sewn-in side pockets 32 within the bag 10 respectively to the laterally opposite ends of the upper rail 26. The tension cables 30 pass over a corresponding pair of pulley wheels 34 on the upper rail 26 and are directed laterally inwardly toward each other for secure attachment to the periphery of a cam wheel 36.

Figure 5:
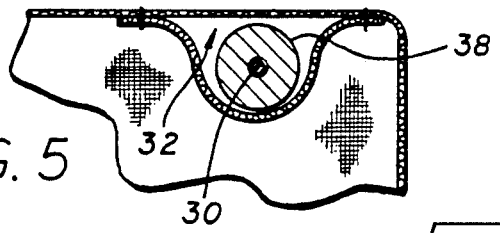
FIG. 5 is an enlarged sectional view taken generally on the line 5—5 of FIG. 4.

The lengths of the tension cables 30 extending between the upper and lower rails 26, 28 are threaded through an interlocking succession of lock segments or links 38 (FIGS. 4 and 5). In general terms, these lock segments 38 are designed to interfit in a rigid manner when the cables 30 are tensioned upon appropriate rotation of the cam wheel 36. Alternatively, the lock segments 38 are adapted for relatively loose and separated movement with respect to each other when cable tension is relaxed. Accordingly, by controlling the tension state of the cables 30, the configuration of the lock segments 38 can be switched between a loose and flexible state, or a stiff and rigid state. While the lock segments are shown to have a tubular geometry, it will be understood that other interlocking shapes can be used.

FIGS. 4 and 5 show the tubular lock segments in the form of rigid cylindrical blocks having a conically projecting nose end 40 for rigid interlocking seating into a mating conical recessed tail end 42 of the adjacent lock segment. Thus, when the associated tension cable 30 is relaxed as viewed in the left-hand portion of the FIG. 4, the lock segments 38 are free to deformably move about and thus do not significantly interfere with luggage bag flexibility between the upper and lower rails 26, 28. By contrast, however, when the tension cable 30 is drawn taught upon rotation of the cam wheel 36, the lock segments 38 are drawn tightly into an interlocked linear configuration providing a substantially rigid structural support link spanning between the upper and lower rails 26, 28.

Figure 6:
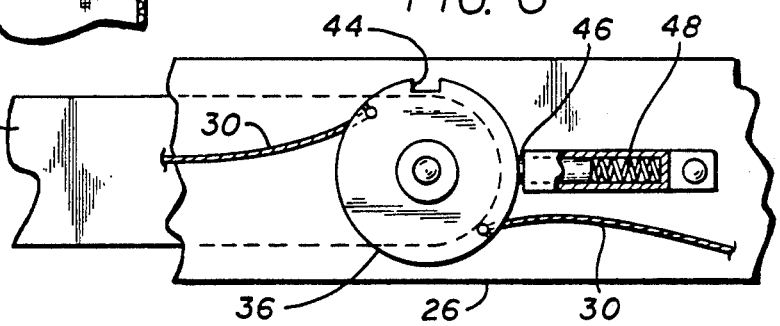
FIG. 6 is an enlarged fragmented plan view corresponding generally with the encircled region 6 of FIG. 4, and depicting a portion of an actuator mechanism for the collapsible frame in a position placing the bag in the soft and flexible state.
Figure 7:
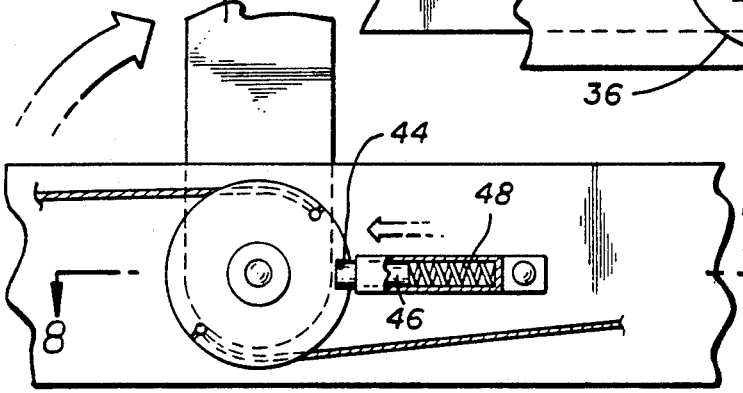
FIG. 7 is a fragmented plan view similar to FIG. 6, but depicting the actuator mechanism in a position placing the bag in the substantially rigid state.
Figure 8:
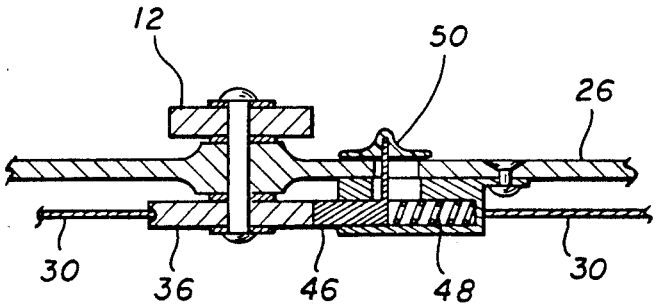
FIG. 8 is an enlarged fragmented vertical sectional view taken generally on the line 8—8 of FIG. 7.

FIGS. 6-8 illustrate the cam wheel 36 in more detail in conjunction with the actuator handle 12 mounted on the bag exterior. More particularly, in the illustrative form of the invention, the cam wheel 36 has a peripheral notch 44 formed therein. Rotation of the actuator handle 12 to a substantially flush position alongside the bag exterior and substantially parallel with the upper rail 26, as viewed in FIG. 2, functions to relax the cable tension and thereby place the luggage bag in a soft or flexibly deformable state. However, rotation of the actuator handle 12 to an upwardly projecting position extending perpendicular to the upper rail 26 (FIGS. 1 and 3) applies substantial tension to the cables 30. When the handle 12 reaches a substantially vertically projecting position, the cam wheel notch 44 is aligned with a spring-loaded latch pin 46 which is urged by a compression spring 48 to advance into the notch 44. As a result, the latch pin 46 retains the cam wheel 36 in a position tensioning the cables 30, and thus rigidifying the luggage bag 10. A release button 50 exposed on the bag exterior can be depressed to retract the latch pin 46 from the cam wheel 36, and thereby permit return actuator handle movement to the flush position (FIG. 2). A second notch (not shown) in the cam wheel 36 can be provided to receive the latch pin when the handle 12 is moved to relax cable tension, thereby retaining the bag in the soft and deformable state until subsequent cam wheel release by depression of the button 50.

Although the handle 12 is shown in the drawings as a rigid link at the exterior of the luggage bag, it will be understood that a distal end of the handle may be adapted to include a soft strap loop or the like for easy manual grasping. Moreover, as shown in dotted lines in FIG. 3, an external pocket 51 can be formed on the bag to receive and conceal the handle 12 in the flush position downside the bag exterior, with bag in the deformable state.

Figure 9:
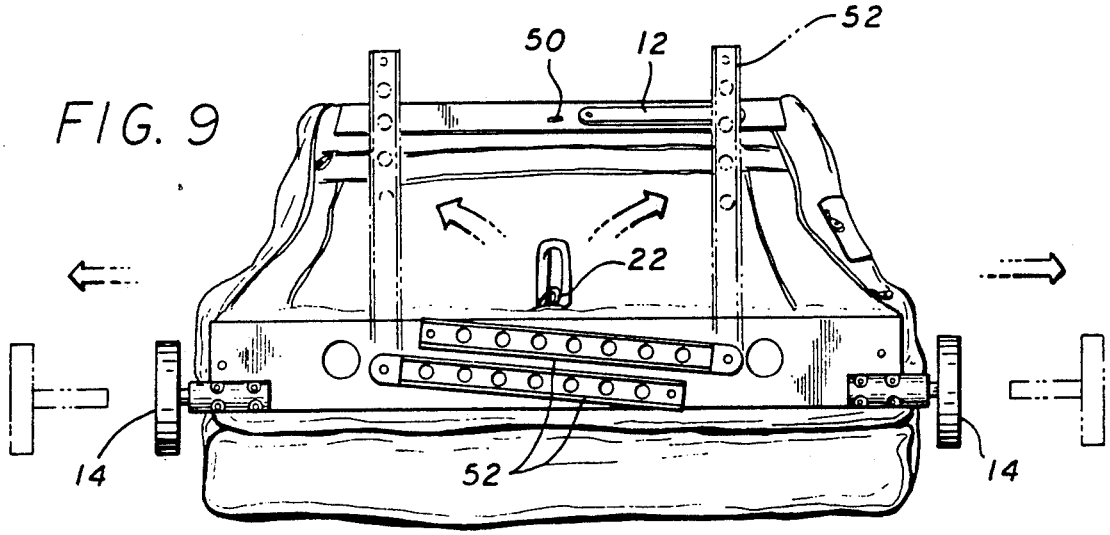
FIG. 9 is a bottom plan view of the bag taken generally on the line 9—9 of FIG. 3.

In accordance with one aspect of the invention, the actuator handle 12 is positioned in the rigid configuration for convenient manual grasping to pull the luggage bag 10 for rolling movement by means of the caster wheels 14 or other suitable rolling support structure. In this regard, the illustrative luggage bag 10 is equipped with a pair of the caster wheels 14 at opposite ends of the lower base portion 18 (FIG. 9). The caster wheels 14 may be permanently or removably mounted to the lower end of the base portion 18, or alternately adapted for back-and-forth movement between deployed and retracted positions, as desired. For example, deployable caster wheels can be mounted to pivot between outwardly projecting deployed positions and retracted positions lying substantially flush against the bag.

Moreover, FIGS. 1 and 9 illustrates a pair of support bars 52 on the external underside of the base portion 18 for swinging movement to outwardly projecting positions to assist in supporting additional luggage items, such as the briefcase 54 shown in dotted lines in FIG. 1.

FIGS. 10 and 11 illustrate an alternative preferred form of the invention, wherein the luggage bag includes the internal rigidifying frame as previously shown and described, in combination with collapsible caster wheels 14' movable between deployed and retracted positions. In addition, the embodiment of FIGS. 10 and 11 utilizes an improved rigidifying lock structure when upper and lower portions 16' and 18' of the bag are folded over each other.

More particularly, the base portion 18' of the modified bag includes a rigid base plate 60 having the caster wheels 14' mounted thereon at oposite ends thereof. The caster wheels 14' include hinged brackets 62 which accommodate movement of the caster wheels between retracted positions conveniently nested within mating recesses in the base plate 60, and deployed positions with the caster wheels oriented to provide rolling support for the bag. In a preferred construction, the hinge brackets 62 are spring-loaded to deploy the caster wheels when the internal frame of the bag is rigidified, and to permit manual return of the caster wheels to the nondeployed position.

The base plate 60 on the lower portion 18' of the bag is adapted to interlock with a corresponding top plate 64 at the top of the upper portion 16', when the bag portions 16', 18' are folded over one another. Although different interlock mechanisms may be used, FIGS. 10 and 11 show laterally projecting pegs 66 on the base plate 60 to fit into mating holes 68 on the adjacent side edge of the top plate 64. A suitcase type latch 70 on the base plate is then engageable with a keeper 72 on the top plate to securely interlock the plates 60, 66 as a rigid support structure for the folded bag. Swingably mounted support bars 52' on the top plate 66 can be pivoted outwardly to support additional luggage items, if desired.

The improved luggage 10 of the present invention thus provides a convenient and lightweight luggage product which can be shifted back-and-forth between flexible and rigid configurations, as desired.

A variety of further modifications and improvements to the improved luggage bag of the present invention will be apparent to those skilled in the art. For example, although one actuator mechanism including the cam wheel 36 and related latch pin 46 has been depicted by way of example in the accompanying drawings, it will be understood that other types of actuator mechanisms such as ratchet drives and the like may be used, as desired. Accordingly, no limitation on the invention is intended by way of the foregoing description and accompanying drawings, except as set forth in the appended claims.

What is claimed is:

1. A luggage bag, comprising:

a substantially flexible bag adapted to receive and contain personal items; and a rigidifying frame connecting to the interior of said bag and including means movable between a relatively rigid state to place the bag in a substantially rigid configuration, and a relatively flexible state to place the bag in a relatively soft and deformable configuration;

said means comprising a tension cable having opposite ends connected to said frame at spaced positions, said tension cable being threaded through a succession of generally tubular and interlocking lock segments, and further including actuator means for respectively applying tension to and relaxing tension on said cable to place said frame respectively in said rigid state with said lock segments drawn to a substantially rigid linear configuration and said flexible state with said lock segments retained loosely about said cable.

2. The luggage bag of claim 1 wherein said flexible bag has a bag exterior formed at least in part from a relatively flexible bag material.

3. The luggage bag of claim 1 wherein said actuator means is operable from the exterior of the bag for moving said frame between said substantially rigid and relatively flexible states.

4. The luggage bag of claim 3 wherein said actuator means includes means for releasibly locking the bag in said substantially rigid state.

5. The luggage bag of claim 3 further including at least one caster member mounted on said bag for rolling support thereof, said actuator means comprising a handle on the exterior of the bag movable between a first position substantially flush with the bag exterior to place said frame in the relatively flexible state and a second position projecting outwardly from the bag to place said frame in the substantially rigid state, said handle in said second position being manually graspable for facilitated maneuvering of the bag on said caster member.

6. The luggage bag of claim 5 further including pocket means for receiving said actuator means when said actuator means is in said first position.

7. The luggage bag of claim 1 wherein said frame further comprises upper and lower relatively rigid rails, and said tension cable comprising a pair of tension cables connected between said rails generally at opposite ends thereof, each of said tension cables being threaded through a succession of the generally tubular interlocking lock segments and said actuator means being for respectively applying tension to and relaxing tension on said cables to place said frame respectively in said rigid state and said flexible state.

8. A luggage bag, comprising:

a bag adapted to receive and contain personal items, and having a bag exterior defined by substantial portions formed from a flexible material to permit deformation to a compact storage volume;

a rigidifying frame connected to said bag interior and including means movable between a relatively rigid state to place the bag in a substantially rigid configuration, and a relatively flexible state to place the bag in a relatively soft and deformable configuration; and actuator means accessible and operable from the exterior of the bag for moving said frame between the substantially rigid and relatively flexible states;

said movable means comprising a tension cable having opposite ends connected to said frame at spaced positions, said tension cable being threaded through a succession of generally tubular and interlocking lock segments, said actuator means being for respectively applying tension to and relaxing tension on said cable to place said frame respectively in said rigid state with said lock segments drawn to a substantially rigid linear configuration, and said flexible state with said lock segments retained loosely about said cable.

9. The luggage bag of claim 8 wherein said frame is mounted substantially within the bag.

10. The luggage bag of claim 8 wherein said actuator means includes means for releasibly locking the bag in said substantially rigid state.

11. The luggage bag of claim 8 further including at least one caster member mounted on said bag for rolling support thereof, said actuator means comprising a handle on the exterior of the bag movable between a first position substantially flush with the bag exterior to place said frame in the relatively flexible state and a second position projecting outwardly from the bag to place said frame in the substantially rigid state, said handle in said second position being manually graspable for facilitated maneuvering of the bag on said caster member.

12. The luggage bag of claim 11 further including pocket means for receiving said actuator means when said actuator means is in said first position.

13. The luggage bag of claim 8 wherein said frame comprises upper and lower relatively rigid rails, and said tension cable comprising a pair of tension cables connected between said rails generally at opposite ends thereof, each of said tension cables being threaded through a succession of the generally tubular interlocking lock segments, said actuator means being for respectively applying tension to and relaxing tension on said cables to place said frame respectively in said rigid state and said flexible state.

14. The luggage bag of claim 13 wherein said actuator means comprises a lever handle for respectively applying tension to and relaxing tension on said cables to place said frame respectively in said rigid state and said flexible state.

15. The luggage bag of claim 8 wherein said bag comprises a fold-over garment bag having an upper portion foldable with respect to a base portion, said frame being mounted within said base portion.

16. The luggage bag of claim 15 wherein said base portion has a rigid base plate at a lower end thereof, and wherein said upper portion has a rigid top plate at an upper end thereof, and further including means for interlocking said base plate and said top plate in side-by-side relation when said upper portion is folded over said base portion.

17. A luggage bag, comprising:

a substantially flexible bag adapted to receive and contain personal items;

a rigidifying frame connected to the interior of said bag and including means movable between a relatively rigid state to place the bag in a substantially rigid configuration, and a relatively flexible state to place the bag in a relatively soft and deformable configuration;

said rigidifying frame comprising at least one elongated frame element connected to said bag at spaced positions, said frame element being deployable in the substantially rigid configuration and in the flexible state;

at least one caster member mounted on said bag for rolling support thereof;

actuator means comprising a handle on the exterior of the bag movable between a first position substantially flush with the bag exterior to place said frame in a relatively flexible state and a second position projecting outwardly from the bag to place said frame in the substantially rigid state, said handle in said second position being manually graspable for facilitated maneuvering of the bag on said caster member; and pocket means for receiving said actuator means when said actuator means is in said first position.

18. A luggage bag, comprising:

a substantially flexible bag adapted to receive and contain personal items;

rigidifying frame means within said bag and including at least one elongated frame element connected to said bag at spaced positions and being deployable in a relatively flexible state wherein said frame element is deformable for a substantial portion of the length thereof, and in a relatively rigid state wherein said frame element defines a substantially rigid column, and actuator means for selectively deploying said frame element between said flexible and rigid state;

said frame element comprising at least one tension cable threaded through a succession of generally tubular lock segments adapted to interlock end-to-end upon tensioning of said cable and to fit relatively loosely about said cable when the tension is released, said actuator means including means for moving said cable between a tensioned and a relaxed state.

19. The luggage bag of claim 18 wherein said actuator means is operable from the exterior of said bag.

20. The luggage bag of claim 18 wherein said bag has a generally rectangular shape, said frame means including relatively rigid upper and lower rails, and said at least one tension cable comprising a pair of tension cables connected between said rails generally at opposite ends thereof.

21. The luggage bag of claim 20 wherein said bag comprising a foldover garment bag having an upper portion foldable with respect to a base portion, said frame means being mounted within said base portion.

* * * * *